US006257910B1

(12) United States Patent
Mramor

(10) Patent No.: US 6,257,910 B1
(45) Date of Patent: Jul. 10, 2001

(54) SHORTING CLIP FOR AIR BAG INFLATOR

(75) Inventor: Vincent J. Mramor, Chandler, AZ (US)

(73) Assignee: TRW Inc., Lyndhurst, OH (US)

( * ) Notice: Subject to any disclaimer, the term of this patent is extended or adjusted under 35 U.S.C. 154(b) by 0 days.

(21) Appl. No.: 09/347,505

(22) Filed: Jul. 2, 1999

(51) Int. Cl.[7] ..... H01R 29/00

(52) U.S. Cl. ..... 439/188; 439/507; 439/557; 439/567; 200/51.1

(58) Field of Search ..... 439/188, 557, 439/567, 507; 200/51.1

(56) References Cited

U.S. PATENT DOCUMENTS 5,178,547 1/1993 Bonas et al. .
5,241,910 9/1993 Cunningham et al. .
5,275,575 1/1994 Cahaly et al. .
5,314,345 5/1994 Cahaly et al. .
5,462,448 10/1995 Kida et al. .
5,529,507 * 6/1996 Felix et al. ..... 439/188
5,733,135 3/1998 Kennedy et al. .
6,073,963 * 6/2000 Hamilton et al. ..... 280/741

* cited by examiner

*Primary Examiner*—Paula Bradley
*Assistant Examiner*—Truc Nguyen
(74) *Attorney, Agent, or Firm*—Tarolli, Sundheim, Covell, Tummino & Szabo L.L.P.

(57) ABSTRACT

An apparatus (60) for association with an electrical connector (68) includes an igniter (62) actuatable to initiate actuation of an inflator (10) in response to receiving an electrical signal. The igniter has a pair of electrical terminals (64, 66) for electrical contact with the electrical connector (68). The apparatus (60) includes a retainer (70) for supporting the igniter (62) adjacent the inflator (10). The retainer (70) has a recess (94). The apparatus (60) includes a shorting clip (100) for maintaining the electrical connector (68) in electrical contact with the electrical terminals (64, 66) and for establishing a short circuit between the electrical terminals when the electrical connector is not in electrical contact with the electrical terminals. The shorting clip (100) includes a main body portion (102) and at least one locking foot (140, 150) movable relative to the main body portion and into the recess (94) in the retainer (70) for attaching the shorting clip to the igniter (62).

8 Claims, 3 Drawing Sheets

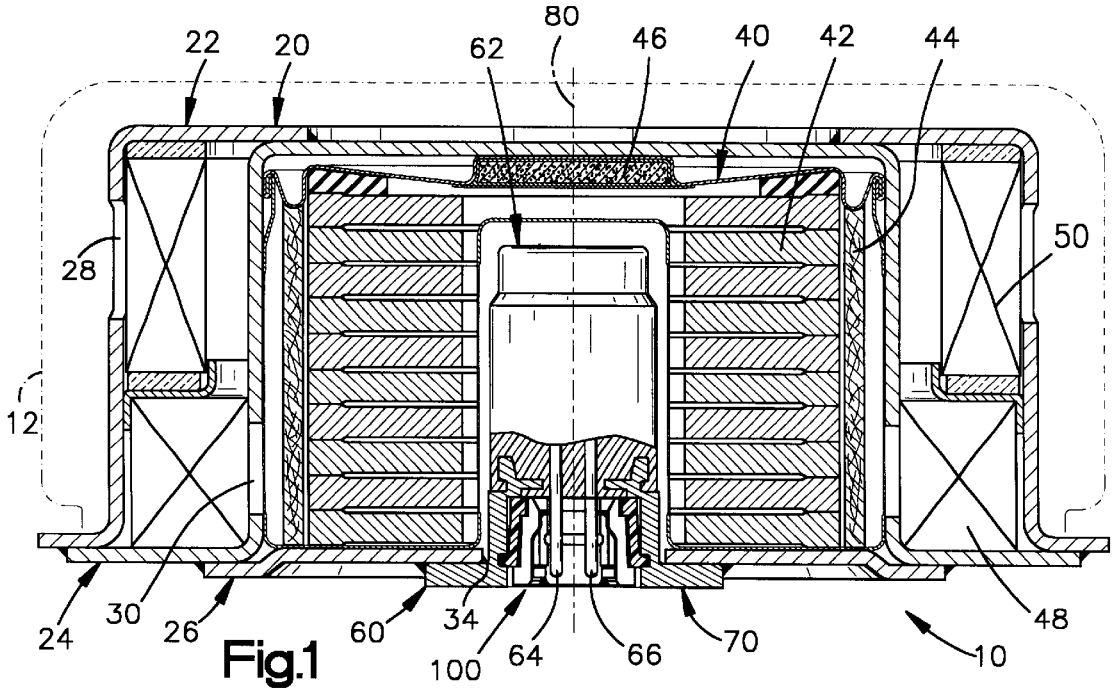
Fig.1
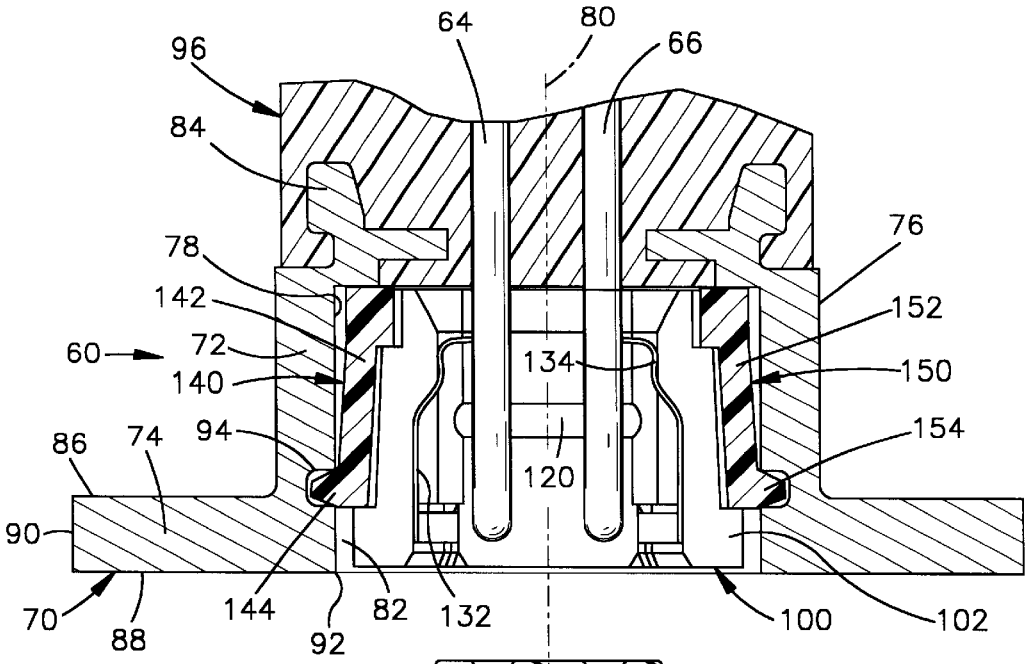
Fig.3
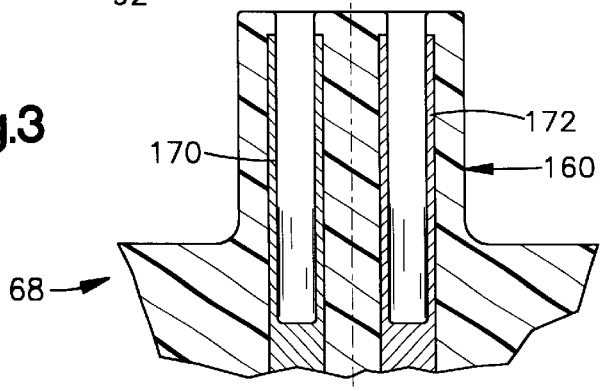

SHORTING CLIP FOR AIR BAG INFLATOR

BACKGROUND OF THE INVENTION

1. Technical Field

The present invention relates to an inflator for inflating a vehicle occupant protection device to help protect an occupant of a vehicle. In particular, the present invention relates to a shorting clip for an inflator having an electrically energizable initiator.

2. Description of the Prior Art

It is known to protect a vehicle occupant by inflating an air bag with inflation fluid from an air bag inflator. The inflation fluid is released from a container in the inflator and/or generated by ignition of combustible gas generating material in the inflator.

The inflator may use an electrically actuatable initiator to open the container and/or to ignite the gas generating material. A typical initiator has two terminals. The terminals are in electrical contact with an electrical connector which is part of vehicle electric circuitry. To actuate the inflator, the vehicle electric circuitry sends an electric signal through the electrical connector and the terminals to the initiator. The electric signal actuates the initiator, resulting in actuation of the inflator.

U.S. Pat. No. 5,733,135 describes an inflator having an initiator that includes a metal retainer onto which a shorting clip is crimped. Prior to connection of an electrical connector with terminals of the initiator, the shorting clip has electrically conductive portions connected between the terminals to prevent accidental actuation of the initiator. The shorting clip has an opening to receive the electrical connector when the inflator is connected with vehicle electric circuitry. The shorting clip physically maintains the electrical connector in electrical contact with the terminals of the initiator.

SUMMARY OF THE INVENTION

The present invention is an apparatus for association with an electrical connector. The apparatus includes an igniter actuatable to initiate actuation of an inflator in response to receiving an electrical signal. The igniter has a pair of electrical terminals for electrical contact with the electrical connector to receive an electrical signal from the electrical connector. The apparatus includes a retainer for supporting the igniter adjacent the inflator. The retainer has a recess. The apparatus includes a shorting clip for maintaining the electrical connector in electrical contact with the electrical terminals and for establishing a short circuit between the electrical terminals of the igniter when the electrical connector is not in electrical contact with the electrical terminals. The shorting clip includes a main body portion and at least one locking foot movable relative to the main body portion and into the recess in the retainer for attaching the shorting clip to the igniter.

BRIEF DESCRIPTION OF THE DRAWINGS

Further features of the present invention will become apparent to those skilled in the art to which the present invention relates from reading the following specification with reference to the accompanying drawings, in which:

FIG. 1 is a transverse sectional view of an inflator that use an initiator assembly constructed in accordance with the present invention, with a shorting clip in position on the initiator assembly;

FIG. 3 is an enlarged view of the initiator assembly of FIG. 1, showing a portion of an electrical connector in a condition prior to engagement with the initiator assembly;

DESCRIPTION OF A PREFERRED EMBODIMENT

Figure 2:
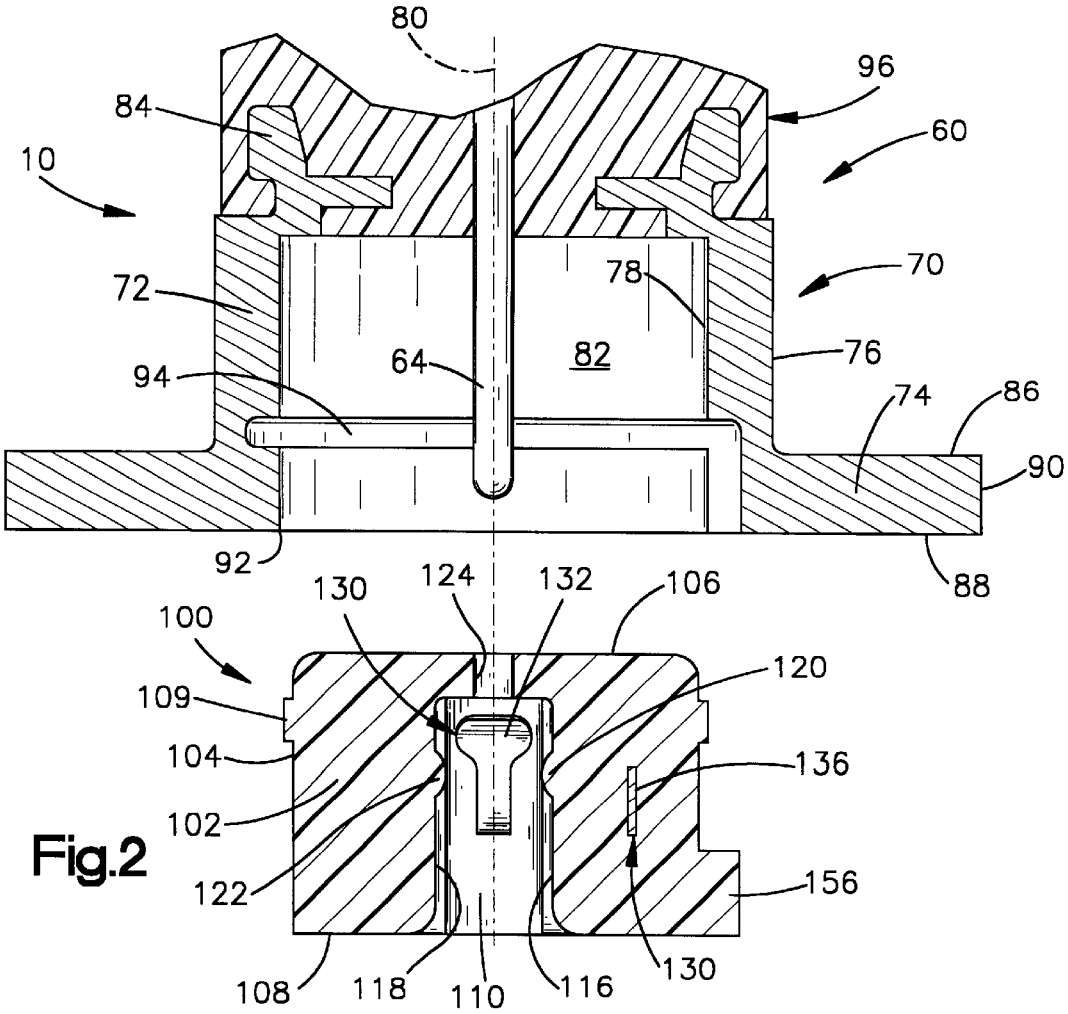
FIG. 2 is a sectional view of a portion of the initiator assembly, showing the shorting clip in a condition prior to assembly into the initiator assembly.

The present invention relates to an inflator for inflating a vehicle occupant protection device to help protect an occupant of a vehicle. The present invention is applicable to various inflator constructions, including inflators of different shapes and sizes and inflators with different modes of operation. For example, the invention can be applied to inflators which release inflation fluid from a container and/or which generate inflation fluid by ignition of combustible gas generating material.

As representative of the present invention, FIG. 1 illustrates an inflator 10 for inflating an air bag indicated schematically at 12. The inflating air bag 12 moves into the space between a driver of a vehicle and a vehicle steering wheel (not shown) to help protect the driver of the vehicle.

The inflator 10 (FIG. 2) includes a housing 20. The housing 20 is made of three pieces, namely, a diffuser cup 22, a combustion cup 24, and a combustion chamber cover 26. The diffuser cup 22 encloses the combustion cup 24 and has an annular array of gas outlet openings 28 formed in its upper portion. The combustion cup 24 has an annular array of openings 30 located in its lower portion and is welded with continuous welds to the diffuser cup 22. The combustion chamber cover 26 is a generally flat metal piece having a circular central opening 34. The chamber cover 26 is welded with a continuous weld to the combustion cup 24 to close the combustion cup.

A hermetically sealed canister 40 is disposed in the combustion cup 24. A plurality of annular disks 42 of gas generating material are stacked atop each other within the canister 40. The disks 42 are made of a known material that when ignited, generates nitrogen gas. Although many types of gas generating material could be used, suitable gas generating materials are disclosed in U.S. Pat. No. 3,895,098. An annular prefilter 44 is disposed in the canister 40, radially outward of the gas generating disks 42. A small recess in the center of the canister cover receives a packet 46 of auto ignition material.

An annular slag screen indicated schematically at 48 is located in the diffuser cup 22 radially outward of the openings 30 in the combustion cup 24. An annular final filter assembly indicated schematically at 50 is located above the slag screen 48. The final filter assembly 50 is radially inward of the gas outlet openings 28 in the diffuser cup 22.

The inflator 10 includes an initiator assembly 60. The initiator assembly 60 includes an igniter 62 which projects through the opening 34 in the chamber cover 26 into the canister 40. The igniter 62 may be of any suitable well known construction and includes a resistance wire (not shown) embedded in a known ignition material (not shown) in the igniter. The igniter 62 has a pair of externally projecting terminals in the form of cylindrical metal pins 64 and 66. The terminals 64 and 66 are connected to the resistance wire in the igniter 62.

When the inflator 10 is mounted in the vehicle, the terminals 64 and 66 are electrically connected with an electrical connector 68 (FIG. 4) in a manner described below. The electrical connector 68 is connected to vehicle electric circuitry (not shown), including a vehicle condition sensor, for receiving an electrical signal to actuate the igniter 62. The electrical connector 68 is a commercially available part and is typically supplied by the manufacturer of the vehicle in which the inflator 10 is mounted, rather than by the manufacturer of the inflator.

In addition to the igniter 62, the initiator assembly 60 includes a retainer 70 (FIGS. 2–4) for securing the igniter to the housing 20 of the inflator 10. The retainer 70 is preferably made of a weldable metal suitable for cold heading, such as UNS S30430 stainless steel.

The retainer 70 includes a tubular, axially extending socket portion 72 and an annular, radially extending flange portion 74 at one end of the socket portion. The socket portion 72 has cylindrical outer and inner circumferential surfaces 76 and 78 centered on an axis 80 of the inflator 10. The socket portion 72 and the flange portion 74 extend circumferentially around a central opening 82 of the retainer 72. An interlock portion 84 of the retainer 70 extends axially inward (upward as viewed in FIG. 2) from the socket portion 72.

The flange portion 74 of the retainer 70 has parallel, radially extending inner and outer side surfaces 86 and 88. An annular outer edge surface 90 extends axially between the inner and outer side surfaces 86 and 88.

The inner circumferential surface 78 of the retainer 70 and the outer side surface 88 of the flange 74 define a circular edge 92 of the retainer 70, extending around the central opening 82. A circumferential recess or groove 94 is formed in the inner circumferential surface 78 of the retainer 70. The groove 94 is located near the edge 92 and thus near the outer side surface 88 of the flange portion 74 of the retainer 70.

A body of plastic material 96 encases and is in intimate contact with the interlock portion 84 of the retainer 70 and with the igniter 62. The terminals 64 and 66 of the igniter 62 extend axially from the body of plastic material 96 into the central opening 82 of the retainer 70. The body of plastic material 96 attaches the retainer 70 to the igniter 62. In the preferred embodiment, the body of plastic material 96 is injection molded nylon with a glass fill. Other materials which can be injection molded at low pressures and temperatures and which will adhere to the retainer 70 and to the igniter 62 are also suitable for use. Alternatively, the body of plastic material 96 could be an epoxy adhesive, or another material which is not injection molded.

The initiator assembly 60 includes a shorting clip 100 which serves several functions in the inflator 10. The shorting clip 100 prevents accidental actuation of the igniter 62 prior to engagement of the electrical connector 68 with the initiator assembly 60. The shorting clip 100 also maintains the electrical connector 68 in electrical contact with the electrical terminals 64 and 66 of the igniter 62 after engagement of the electrical connector with the initiator assembly 60.

The shorting clip 100 (FIGS. 2–6) has a main body portion 102. The main body portion 102 is a single piece of injection molded plastic material having a generally cylindrical configuration. A cylindrical outer side surface 104 of the main body portion of the shorting clip 100 extends parallel to the axis 80. The main body portion 104 of the shorting clip 100 also has parallel, radially extending inner and outer end surfaces 106 and 108. A plurality of locator nubs 109 are formed on the outer side surface 104 of the shorting clip 100, near the inner end surface 106.

The shorting clip 100 has a central opening 110 with a configuration adapted to receive the electrical connector 68. The central opening 110 of the shorting clip 100 is defined generally by a pair of arcuate, axially extending end surfaces 112 and 114 centered on and bowed outwardly from the axis 80, and a pair of arcuate, axially extending side surfaces 116 and 118 which are bowed inwardly toward the axis 80.

A first locking rib 120 is formed on the one side surface 116 of the shorting clip 100. The first locking rib 120 projects from the side surface 116 into the central opening 110 of the shorting clip 100 in a direction toward the axis 80. A second locking rib 122 is formed on the opposite side surface 118. The second locking rib 122 projects from the side surface 118 into the central opening 110 of the shorting clip 100, in a direction toward the axis 80. A terminal opening 124 extends between the inner end surface 106 of the shorting clip 100 and the central opening 110 of the shorting clip.

The shorting clip 100 includes an electrically conductive shorting bar 130 supported on the plastic main body portion 102. The shorting bar 130, preferably made from metal, includes a pair of shorting arms 132 and 134 which project into the central opening 110. The shorting arms 132 and 134 are electrically interconnected by a connector portion 136 (FIG. 2) of the shorting bar 130 extending within the plastic main body portion 102.

The main body portion 102 of the shorting clip 100 includes a pair of locking feet 140 and 150 for attaching the shorting clip 100 to the retainer 70. The locking feet 140 and 150 are identical in construction to each other and are located diametrically opposite each other on the outer periphery of the shorting clip 100.

Figure 6:
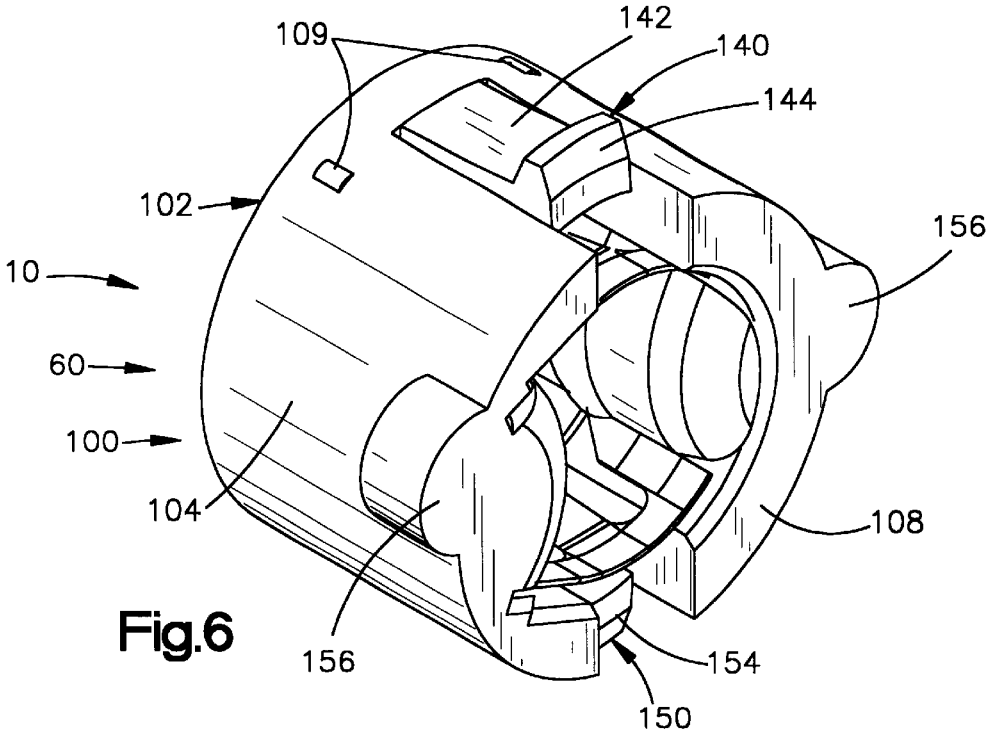
FIG. 6 is a perspective view of the shorting clip.

The locking foot 140 includes a resilient base portion 142 and an end portion 144 formed as a locking tab. The locking foot 150 includes a resilient base portion 152 and an end portion formed as a locking tab 154. The main body portion 102 of the shorting clip 100 is molded so that the locking tabs 144 and 154 are disposed radially outward of the outer side surface 104 of the main body portion when the shorting clip is in a free condition as shown in FIG. 6, that is, not engaged with the retainer 70.

After the igniter 62 is secured to the retainer 70 by the body of plastic material, the retainer is attached to the combustion chamber cover 26 (FIG. 1), preferably by welding to the cover along the outer edge surface 90. The cover 26 is then welded to the combustion cup 24. The igniter 62 is thereby secured in position in the inflator 10. It should be noted that the retainer 70 can be secured to the cover 26 by other means. For example, it is contemplated that the retainer 70 and the cover 26 may have complementary threaded portions which permit the retainer and the cover to be screwed together.

The shorting clip 100 is inserted in the central opening 82 in the retainer 70, shortly after the molding process is completed. When the shorting clip 100 is engaged with the retainer 70, the locator nubs 109 on the outer side surface 104 of the shorting clip 100 have an interference fit with the cylindrical inner surface 78 on the retainer 70. The outer end surface 108 of the shorting clip 100 is disposed flush with or recessed axially away from the outer side surface 88 of the flange portion 74 of the retainer 70.

When the shorting clip 100 is disposed in the central opening 82 in the retainer 70, the electrical terminals 64 and 66 of the igniter extend through the terminal opening 124 in the shorting clip, into the central opening 110 of the shorting clip. The metal shorting arms 132 and 134 of the shorting clip 100 engage the electrical terminals 64 and 66 of the igniter 62, respectively, and connect them electrically. This connection establishes a short circuit between the electrical terminals 64 and 66 of the igniter 62, when the electrical connector 68 is not in electrical contact with the terminals. The short circuit established by the shorting clip 100 does not extend through the bridgewire of the igniter 62. Accordingly, any stray electrical current which might be applied across the electrical terminals 64 and 66 of the igniter 62 does not result in actuation of the ignition material in the igniter, and thus does not cause actuation of the inflator 10.

The shorting clip 100 is secured in the initiator assembly 60 by the locking feet 140 and 150. When the shorting clip 100 is moved axially into the central opening 82 in the retainer 70 as described above, the base portions 142 and 152 of the locking feet 140 and 150, respectively, engage the circular edge 92 on the retainer 70. The locking feet 140 and 150 are urged radially inward relative to the main body portion 102 of the shorting clip. When the shorting clip 100 is moved far enough into the opening 82 in the retainer 70 so that the locking tabs 144 and 154 are adjacent the groove 94 in the retainer 70, the locking feet 140 and 150 snap outward relative to the main body portion 102 of the shorting clip 100. The locking tabs 144 and 154 on the locking feet 140 and 150 engage in the groove 94.

Figure 4:
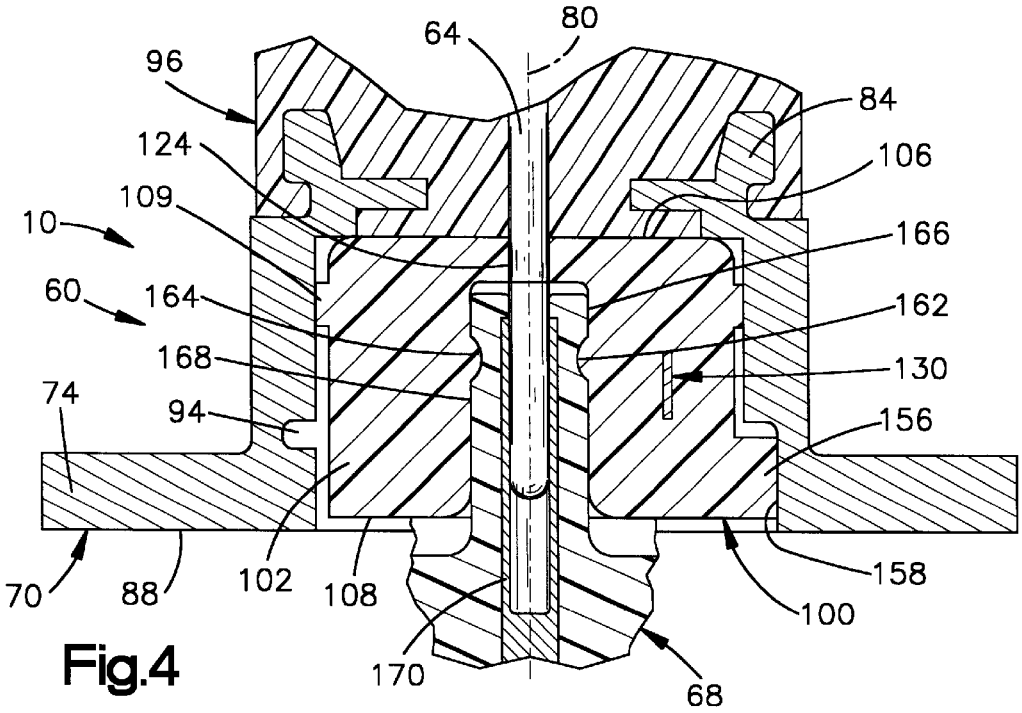
FIG. 4 is a view similar to FIG. 3 showing both the shorting clip and the electrical connector in position on the initiator assembly.
Figure 5:
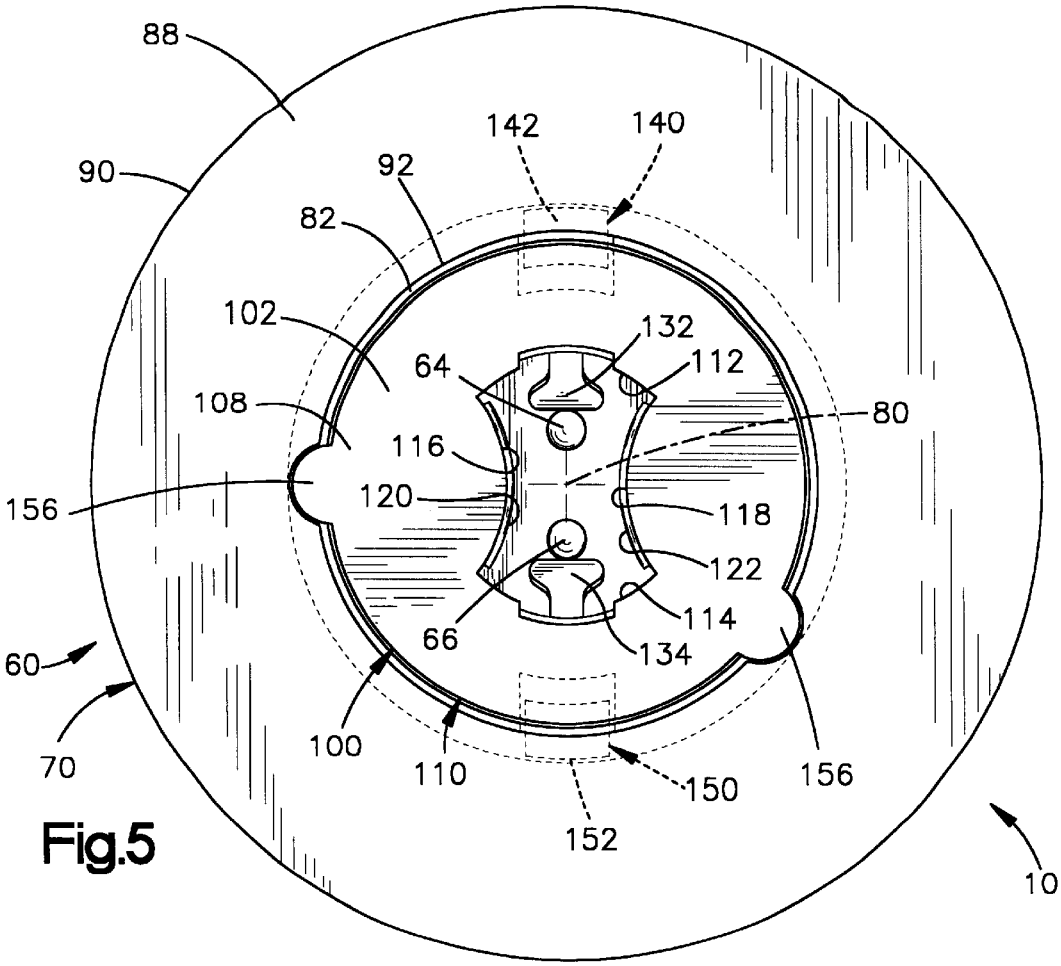
FIG. 5 is a bottom plan view of the initiator assembly and shorting clip.

The engagement of the locking tabs 144 and 154 of the shorting clip 100 in the groove 94 of the retainer 70 blocks movement of the shorting clip 100 in a downward direction as viewed in FIGS. 2 and 4, out of the central opening 82 in the retainer 70. The locking feet 140 and 150 thus hold the shorting clip 100 in position axially relative to the igniter 62 and maintain the shorting clip in electrical contact with the electrical terminals 64 and 66 of the igniter 62. A pair of circumferential locator tabs 156 on the shorting clip 100 engage in notches 158 in the retainer 70 to ensure proper circumferential alignment of the parts.

When the inflator 10 is, thereafter, mounted in the vehicle, the inflator is electrically connected to the vehicle electric circuitry by the electrical connector 68. The electrical connector 68 has a projecting portion 160, made of an electrically insulating material such as plastic. A pair of locking grooves 162 and 164 are formed on opposite facing side surfaces 166 and 168, respectively, of the projecting portion 160 of the electrical connector 68. Two split cylindrical metal sleeves 170 and 172 are molded into the projecting portion 160 of the electrical connector 68. The metal sleeves 170 and 172 connect to lead wires (not shown) which extend away from the electrical connector 68 and which are connectable to the vehicle electric circuitry for receiving an actuating signal for the igniter 62.

The projecting portion 160 of the electrical connector 68 fits into the central opening 110 in the shorting clip 100. The metal terminals 64 and 66 of the igniter 62 are received in the metal sleeves 170 and 172, respectively, of the electrical connector 68 to establish electrical contact between the igniter 62 and the vehicle electric circuitry. At the same time, the projecting portion 160 of the electrical connector 68 spreads apart the shorting arms 132 and 134 of the shorting clip 100 to disconnect the short circuit established by the shorting clip.

The external configuration of the projecting portion 160 of the electrical connector 68 is adapted to interlock with the internal configuration of the shorting clip 100, that is, with the surfaces which define the central opening 110 in the shorting clip. With the projecting portion 160 of the electrical connector 68 disposed in the central opening 110 in the shorting clip 100, the rib 120 on the inner side surface 116 of the shorting clip fits into the groove 162 on the outer side surface 166 of the projecting portion of the electrical connector. Similarly, the rib 122 on the inner side surface 118 of the shorting clip 100 fits into the groove 164 on the outer side surface 168 of the projecting portion 160 of the electrical connector 68. The engagement between the ribs 120 and 122 on the shorting clip 100 and the grooves 162 and 164 on the electrical connector 68, resists movement of the electrical connector axially outwardly of the inflator 10, that is, in a direction away from the igniter 62. Thus, the interlocking engagement between the shorting clip 100 and the electrical connector 68 maintains the electrical connector in electrical contact with the electrical terminals 64 and 66 of the igniter 62.

Upon sensing of a vehicle condition for which inflation of the air bag 12 is desired for protection of a vehicle occupant, an electrical actuating signal is transmitted through the electrical connector 68 and through the terminals 64 and 66 to the igniter 62. The igniter 62 is actuated and provides hot combustion products which flow outwardly from the igniter 62 and rupture an inner wall of the canister 40. The hot combustion products from the igniter 62 ignite the disks 42 of gas generating material. The disks 42 of gas generating material rapidly produce a large volume of inflation fluid.

The pressure of the inflation fluid ruptures the outer side wall of the canister 40. The inflation fluid then flows radially outwardly through the prefilter 44, through the openings 30 and into the slag screen 48. The inflation fluid flows axially upward from the slag screen 48 to the final filter assembly 50. The gas then flows radially outwardly through the final filter assembly 50 and the gas outlet openings 28 into the air bag 12.

The construction of the inflator 10 is such that the inflator is suitable for use in different vehicles. Different vehicles in which the inflator 10 can be mounted can include electrical connectors having a configuration different from the configuration of the electrical connector 68. Because the shorting clip 100 is specifically configured to receive and to interlock with the electrical connector 68, a differently configured electrical connector likely would not interlock with the shorting clip 100. Thus, the differently configured electrical connector likely would not be maintained in electrical contact with the electrical terminals 64 and 66 of the inflator 10.

Accordingly, the inflator 10 alternatively can include, in place of the initiator assembly 60, an initiator assembly that includes a shorting clip which has an internal configuration different from that of the shorting clip 100. As a result, the inflator 10 including the retainer 70 can be connected with an electrical connector that has a configuration different from the configuration of the electrical connector 68. This is done by providing a shorting clip which has the same external configuration as the shorting clip 100, but with a central opening having a configuration different from that of the central opening 110 of the shorting clip 100 so as to receive a differently configured electrical connector.

Thus, shorting clips which are constructed in accordance with the present invention may have an internal configuration different from those configurations illustrated in the drawings, in order to interlock with electrical connectors different from those shown in the drawings. Also, the engagement between a particular shorting clip and its associated electrical connector need not constitute an engagement between outer side surfaces on the electrical connector and inner side surfaces on the shorting clip. For example, an electrical connector may have inner side surfaces which engage or interlock with outer side surfaces on a shorting clip in order to maintain the electrical connector in electrical contact with the electrical terminals of the igniter.

From the above description of the invention, those skilled in the art will perceive improvements, changes and modifications in the invention. Such improvements, changes and modifications within the skill of the art are intended to be covered by the appended claims.

Having described the invention, I claim:

1. An apparatus for association with an electrical connector and for, when actuated, initiating actuation of an inflator for discharging inflation fluid to inflate a vehicle occupant protection device such as an air bag, said apparatus comprising:

an igniter actuatable to initiate actuation of the inflator in response to receiving an electrical signal, said igniter having a pair of electrical terminals for electrical contact with the electrical connector to receive the electrical signal from the electrical connector;

a retainer for supporting said igniter adjacent the inflator, said retainer having at least one recess; and a shorting clip for maintaining the electrical connector in electrical contact with said electrical terminals and for establishing a short circuit between said electrical terminals of said igniter when said electrical connector is not in electrical contact with said electrical terminals;

said shorting clip including a main body portion a first locking foot freely movable relative to said main body portion, and a second locking foot freely movable relative to said main body portion and into said at least one recess in said retainer for attaching said shorting clip to said igniter;

said main body portion of said shorting clip having a generally cylindrical outer periphery, said first and second locking feet projecting from said main body portion of said shorting clip at locations spaced circumferentially about said outer periphery of said shorting clip.

2. An apparatus as set forth in claim 1 wherein said at least one recess in said retainer is a single circular groove receiving both said first and second locking feet.

3. An apparatus as set forth in claim 2 wherein said locking feet are located diametrically opposite each other on said main body portion of said shorting clip.

4. An apparatus as set forth in claim 1 wherein said first and second locking feet are connected with each other only through said main body portion of said shorting clip, said first locking foot having a terminal end portion that is freely movable relative to a terminal end portion of said second locking foot.

5. An apparatus for association with an electrical connector and for, when actuated, initiating actuation of an inflator for discharging inflation fluid to inflate a vehicle occupant protection device such as an air bag, said apparatus comprising:

an igniter actuatable to initiate actuation of the inflator in response to receiving an electrical signal, said igniter having a pair of electrical terminals for electrical contact with the electrical connector to receive the electrical signal from the electrical connector;

a retainer for supporting said igniter adjacent the inflator, said retainer having at least one recess; and a shorting clip for maintaining the electrical connector in electrical contact with said electrical terminals and for establishing a short circuit between said electrical terminals of said igniter when said electrical connector is not in electrical contact with said electrical terminals;

said shorting clip including a main body portion, a first locking foot freely movable relative to said main body portion, and a second locking foot freely movable relative to said main body portion and into said recess in said retainer for attaching said shorting clip to said igniter;

each one of said locking feet having a resilient base portion connected with said main body portion of said shorting clip and having a respective terminal end portion;

said first and second locking feet being connected with each other only through said main body portion of said shorting clip, said terminal end portion of said first locking foot being freely movable relative to said terminal end portion of said second locking foot.

6. An apparatus as set forth in claim 5 wherein said main body portion of said shorting clip has a generally cylindrical outer periphery, said first and second locking feet projecting from said main body portion of said shorting clip at locations spaced circumferentially about said outer periphery of said shorting clip.

7. An apparatus as set forth in claim 6 therein said at least one recess in said retainer is a single circular groove receiving both said first and second locking feet.

8. An apparatus as set forth in claim 7 wherein said locking feet are located diametrically opposite each other on said main body portion of said shorting clip.

* * * * *